US006032302A

United States Patent [19]

Eckert

[11] Patent Number: 6,032,302

[45] Date of Patent: Mar. 7, 2000

[54] TOILET GUARD SYSTEM

[76] Inventor: Donna M. Eckert, 604 Prospect Ave., Morrisville, Pa. 19067

[21] Appl. No.: 09/249,263

[22] Filed: Feb. 12, 1999

[51] Int. Cl.[7] ..... E03D 9/00

[52] U.S. Cl. ..... 4/300.3

[58] Field of Search ..... 4/300.3, 661, DIG. 5

[56] References Cited

U.S. PATENT DOCUMENTS 2,583,718 1/1952 Walls ..... 4/300.3 X
4,348,776 9/1982 Sarjeant ..... 4/300.3

*Primary Examiner*—Robert M. Fetsuga

[57] ABSTRACT

A toilet guard system including a plurality of side segments. Each side segment having a lower edge and an upwardly extending trapezoidal shaped component including a plurality on each side in overlapping relationship to form two sets. A horizontal coupling member is positioned on the inner surface of the toilet bowl with a vertical element in contact with the interior vertical face of a toilet bowl for proper positioning therebetween. The coupling member also has spaced horizontal ledges positionable above and below the toilet for securement purposes. The coupling member and side segments are in a generally circular orientation with an opening at the forward region of the toilet for urination therebetween and an opening at the rearward region for receipt of the upper component. A plurality of hinges interconnect the coupling component and the side segment components to allow the upward extension of the shielding components for operation and use and to allow the pivoting downwardly thereof for storage purposes.

4 Claims, 3 Drawing Sheets

TOILET GUARD SYSTEM

BACKGROUND OF THE INVENTION

1. Field of the Invention

The present invention relates to a toilet bowl guard system and more particularly pertains to ensuring proper urination by young males into a toilet bowl.

2. Description of the Prior Art

The use of toilets and related components of known designs and configurations is known in the prior art. More specifically, toilet guards and related components of known designs and configurations heretofore devised and utilized for the purpose of ensuring the proper urination of young males through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S Pat. No. Des. 394,497 to Johnson discloses a Toilet Lid Splash Guard. U.S Pat. No. 5,564,135 to Jones et al. discloses a Toilet Bowl Splash Guard. U.S. Pat. No. Des. 353,659 to Hall discloses a Combination Toilet Bowl Rim and Splash Guard. U.S. Pat. No. Des. 341,414 to Baker discloses a Splash Guard for Toilet Bowl. U.S. Pat. No. 4,912,784 to Jacobson et al. discloses a Toilet Bowl Splash Guard. U.S. Pat. No. 4,831,669 to Edwards discloses a Plunger Splash Guard for a Toilet Bowl. U.S. Pat. No. 4,348,776 to Saijeant discloses a Collapsible Splash Shield for Toilet. U.S. Pat. No. 4,010,497 to Menter et al. discloses a Toilet Splash Guard. Lastly, U.S. Pat. No. Des. 394,900 to Kang discloses a Splash Guard Toilet Shield.

While these devices fulfill their respective, particular objectives and requirements, the aforementioned patents do not describe a toilet guard system that allows as described herein.

In this respect, the toilet guard system according to the present invention substantially departs from the conventional concepts and designs of the prior art, and in doing so provides an apparatus primarily developed for the purpose of Ensuring proper urination by young males into a toilet bowl.

Therefore, it can be appreciated that there exists a continuing need for a new and improved toilet guard system which can be used for ensuring proper urination by young males into a toilet bowl. In this regard, the present invention substantially fulfills this need.

SUMMARY OF THE INVENTION

In view of the foregoing disadvantages inherent in the known types of toilet guard systems and related components of known designs and configurations now present in the prior art, the present invention provides an improved toilet guard system. As such, the general purpose of the present invention, which will be described subsequently in greater detail, is to provide a new and improved toilet guard system and method which has all the advantages of the prior art and none of the disadvantages.

To attain this, the present invention essentially comprises a new and improved toilet guard system for ensuring proper urination by young males into a toilet bowl. The system comprises a central section. The central section has a generally trapezoidal upper component and a forwardly extending lower component with triangular lateral extensions. The upper component has a rear surface with a pile-type fastener secured thereto. The pile-type fastener is removably couplable to a pile-type fastener secured on the lower surface of the seat of a toilet when raised. Also included is a plurality of side segments. Each side segment has a lower edge and an upwardly extending trapezoidal shaped component including three on each side in overlapping relationship to form two sets. Each set of three has an interior component adjacent to the upper component, a forward component and an intermediate component therebetween. A horizontal coupling member is positioned on the inner surface of the toilet bowl with a vertical element in contact with the interior vertical face of a toilet bowl for proper positioning therebetween. The coupling member also has spaced horizontal ledges which are positionable above and below the toilet for securement purposes. The coupling member and side segments are in a generally circular orientation with an opening at the forward region of the toilet for urination therebetween and an opening at the rearward region for receipt of the upper component. A plurality of hinges interconnect the coupling component and the side segments components to allow the upward extension of the shielding components for operation and use and to allow the pivoting downwardly thereof for storage purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet guard system which has all of the advantages of the prior art toilet guard systems and related components of known designs and configurations and none of the disadvantages.

It is another object of the present invention to provide a new and improved toilet guard system which may be easily and efficiently manufactured and marketed.

It is further object of the present invention to provide a new and improved toilet guard system which is of durable and reliable constructions.

An even further object of the present invention is to provide a new and improved toilet guard system which is susceptible of a low cost of manufacture with regard to both materials and labor, and which accordingly is then susceptible of low prices of sale to the consuming public, thereby making such Toilet guard system economically available to the buying public.

Even still another object of the present invention is to provide a toilet guard system for ensuring proper urination by young males into a toilet bowl.

Lastly, it is an object of the present invention to provide a new and improved toilet guard system including a plurality of side segments. Each side segment had a lower edge and an upwardly extending trapezoidal shaped component including a plurality on each side in overlapping relationship to form two sets. A horizontal coupling member is positioned on the inner surface of the toilet bowl with a vertical element in contact with the interior vertical face of a toilet bowl for proper positioning therebetween. The coupling member also has spaced horizontal ledges positionable above and below the toilet for securement purposes. The coupling member and side segments are in a generally circular orientation with an opening at the forward region of the toilet for urination therebetween and an opening at the rearward region for receipt of the upper component. A plurality of hinges interconnect the coupling component and the side segment components to allow the upward extension of the shielding components for operation and use and to allow the pivoting downwardly thereof for storage purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
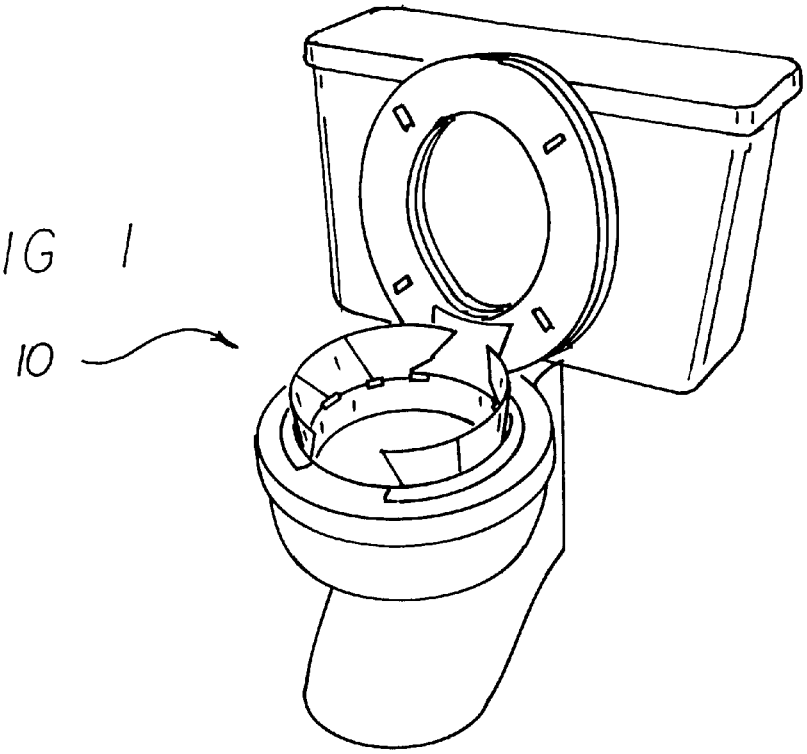
FIG. 1 is a perspective view of the preferred embodiment of the toilet guard system constructed in accordance with the principles of the present invention.
Figure 2:
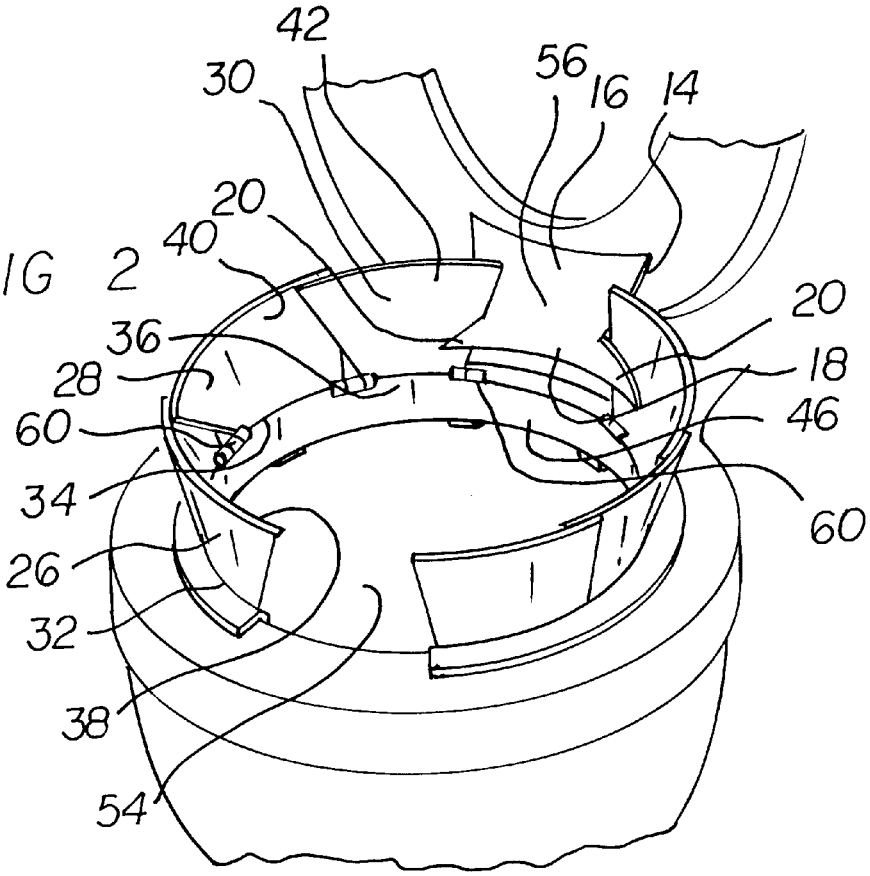
FIG. 2 is an enlarged perspective view similar to that of FIG. 1 but showing less of the toilet.
Figure 3:
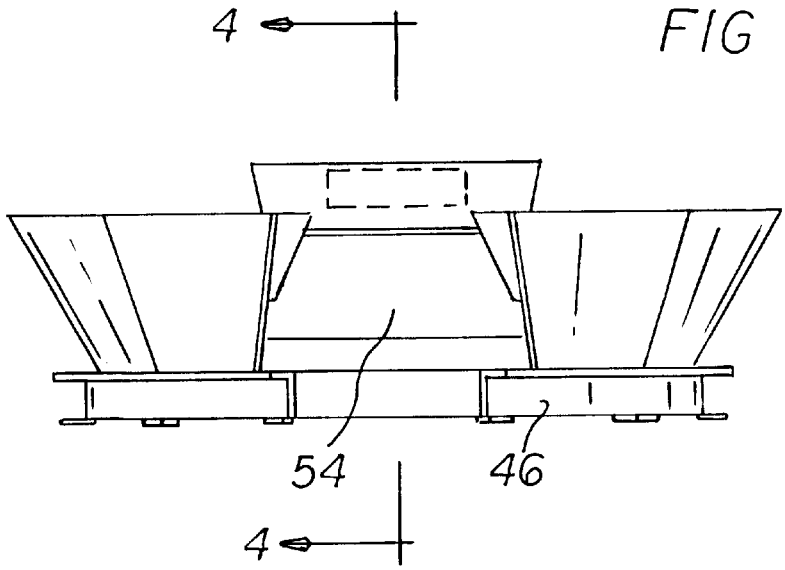
FIG. 3 is a front elevational view of the system shown in FIGS. 1 and 2.
Figure 4:
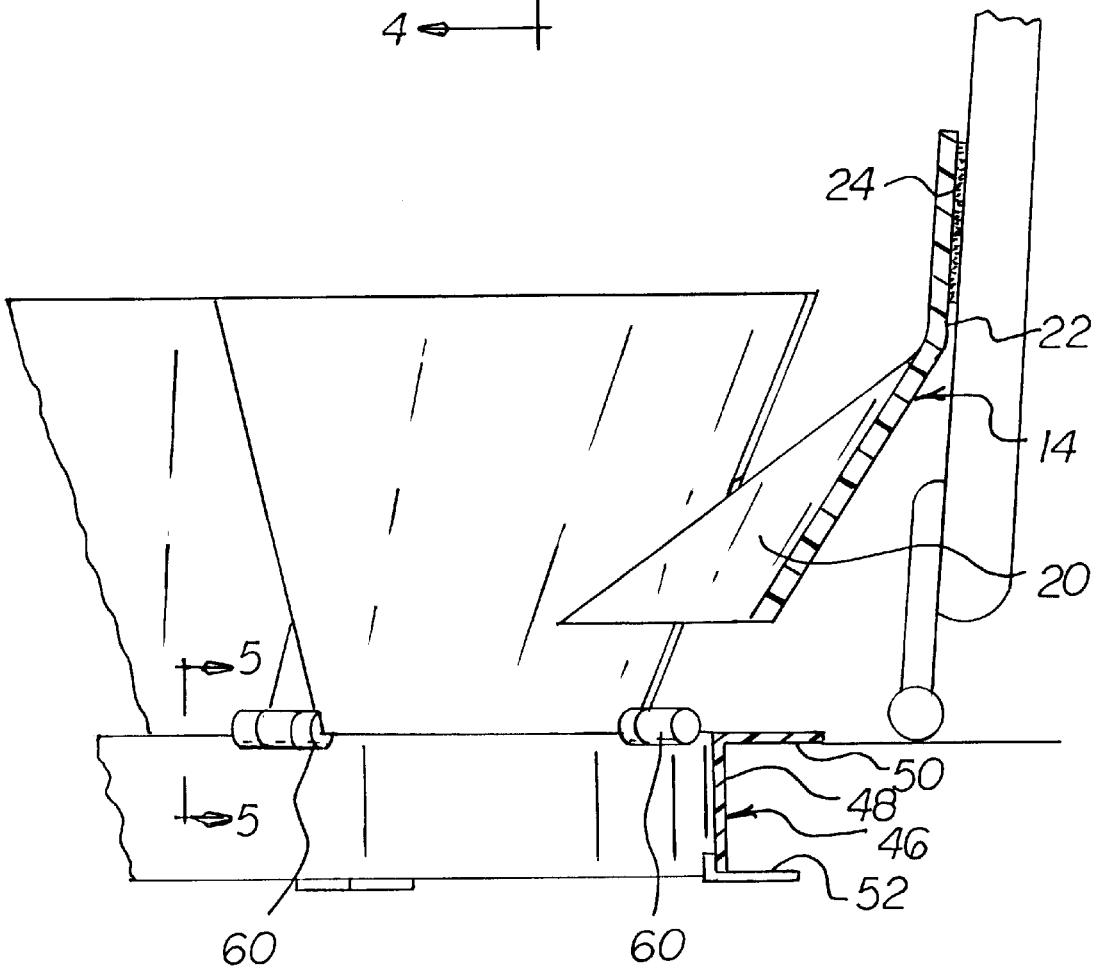
FIG. 4 is a cross-sectional view take along line 4—4 of FIG. 3.
Figure 5:
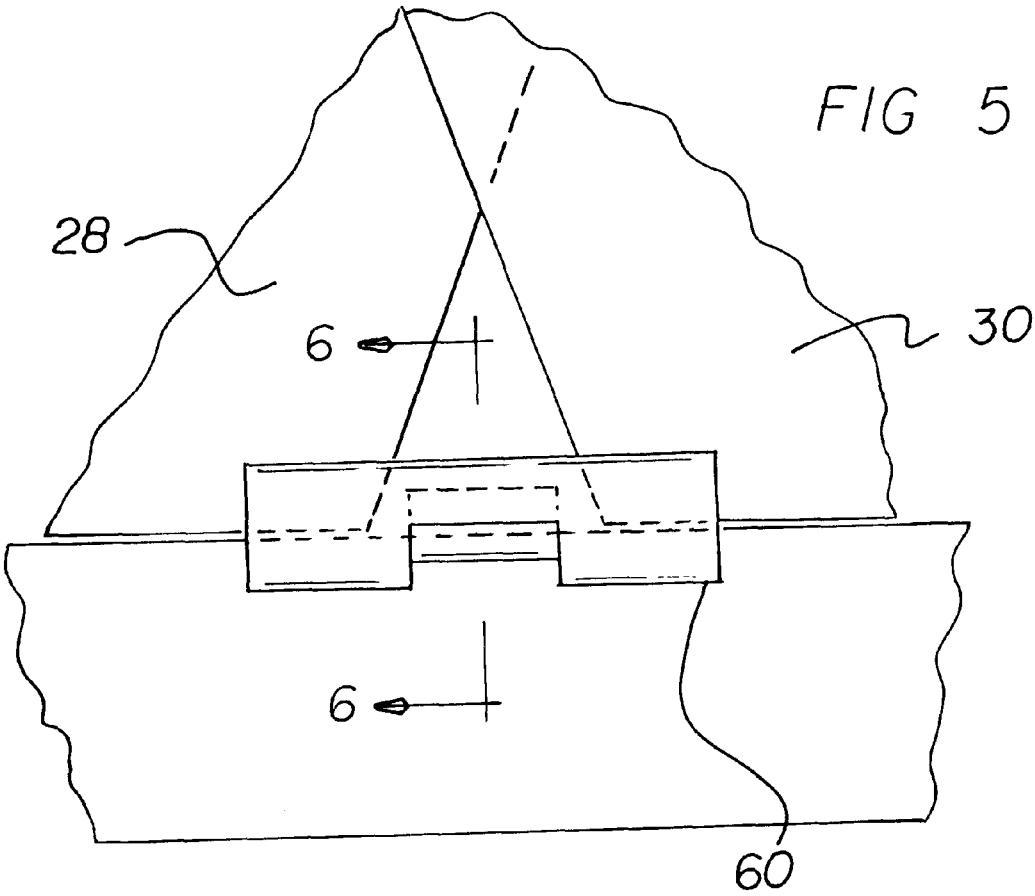
FIG. 5 is a cross-sectional view taken along line 5—5 of FIG. 4.
Figure 6:
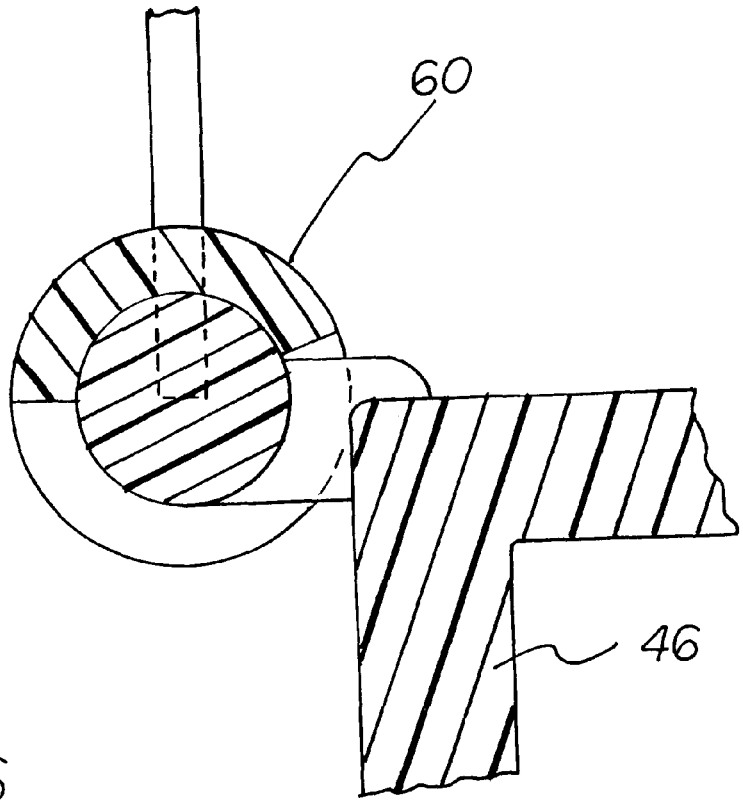
FIG. 6 is a cross-sectional view taken along line 6—6 of FIG. 5.

With reference now to the drawings, and in particular to FIG. 1 thereof, the preferred embodiment of the new and improved Toilet guard system embodying the principles and concepts of the present invention and generally designated by the reference numeral 10 will be described.

The present invention, the toilet guard system 10 is comprised of a plurality of components. Such components in their broadest context include a central section, a plurality of side segments, a coupling member and a plurality of hinges. Such components are individually configured and correlated with respect to each other so as to attain the desired objective.

The new and improved toilet guard system 10 for ensuring proper urination by young males into a toilet bowl comprises, in combination a central section 14. The central section has a generally trapezoidal upper component 16 and a forwardly extending lower component 18 with triangular lateral extensions 20. The upper component has a rear surface 22 with a pile-type fastener 24 secured thereto. The pile-type fastener is removably couplable to a pile-type fastener secured on the lower surface of the seat of a toilet when raised.

Also included is a plurality of side segments 26, 28, 30. Each side segment has a lower edge 32, 34, 36 and an upwardly extending trapezoidal shaped component 38, 40, 42 including three on each side in overlapping relationship to form two sets. Each set of three has an interior component 38 adjacent to the upper component 16, a forward component 42 and an intermediate component 40 therebetween. A horizontal coupling member 46 is positioned on the inner surface of the toilet bowl with a vertical element 48 in contact with the interior vertical face of a toilet bowl for proper positioning therebetween. The coupling member also has spaced horizontal ledges 50, 52 which are positionable above and below the toilet for securement purposes. The coupling member and side segments are in a generally circular orientation with an opening 54 at the forward region of the toilet for urination therebetween and an opening 56 at the rearward region for receipt of the upper component. A plurality of hinges 60 interconnect the coupling component and the side segments components to allow the upward extension of the shielding components for operation and use and to allow the pivoting downwardly thereof for storage purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet guard system comprising:

a plurality of side segments each having a lower edge and an upwardly extending trapezoidal shaped component including a plurality on each side in overlapping relationship to form two sets;

a horizontal coupling member positioned on the inner surface of the toilet bowl with a vertical element in contact with the interior vertical face of a toilet bowl for proper positioning therebetween, the coupling member also having spaced horizontal ledges positionable above and below the toilet for securement purposes, the coupling member and side segments being in a generally circular orientation with an opening at the forward region of the toilet for urination therebetween and an opening at the rearward region for receipt of the upper component; and a plurality of hinges interconnecting the coupling component and the side segments components to allow the upward extension of the shielding components for operation and use and to allow the pivoting downwardly thereof for storage purposes.

2. The system as set forth in claim 1 and further comprising a central section having a generally trapezoidal upper component and a forwardly extending lower component with triangular lateral extensions, the upper component having a rear surface with a pile-type fastener secured thereto removably couplable to a pile-type fastener secured on the lower surface of the seat of a toilet when raised.

3. The system as set forth in claim 1 wherein all the components are fabricated of plastic.

4. A new and improved toilet guard system for ensuring proper urination by young males into a toilet bowl comprising, in combination:

a central section having a generally trapezoidal upper component and a forwardly extending lower component with triangular lateral extensions, the upper component having a rear surface with a pile-type fastener secured thereto removably couplable to a pile-type fastener secured on the lower surface of the seat of a toilet when raised;

a plurality of side segments each having a lower edge and an upwardly extending trapezoidal shaped component including three on each side in overlapping relationship to form two sets, each set of three having an interior component adjacent to the upper component, a forward component and an intermediate component therebetween;

a horizontal coupling member positioned on the inner surface of the toilet bowl with a vertical element in contact with the interior vertical face of a toilet bowl for proper positioning therebetween, the coupling member also having spaced horizontal ledges positionable above and below the toilet for securement purposes, the coupling member ad side segments being in a generally circular orientation with an opening at the forward region of the toilet for urination therebetween and an opening at the rearward region for receipt of the upper component; and a plurality of hinges interconnecting the coupling component and the side segments components to allow the upward extension of the shielding components for operation and use and to allow the pivoting downwardly thereof for storage purposes.

* * * * *